US008566965B2

(12) United States Patent
Shamis et al.

(10) Patent No.: US 8,566,965 B2
(45) Date of Patent: Oct. 29, 2013

(54) ELASTOMERIC ARTICLES HAVING A WELDED SEAM THAT POSSESS STRENGTH AND ELASTICITY

(75) Inventors: Martin S. Shamis, Alpharetta, GA (US); Alphonse Carl DeMarco, Greenville, WI (US); Susan Elaine Shawver, Roswell, GA (US); Steven C. Wasson, Rockford, MI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 47 days.

(21) Appl. No.: 13/285,951

(22) Filed: Oct. 31, 2011

(65) Prior Publication Data

US 2013/0104287 A1 May 2, 2013

(51) Int. Cl.
*A41D 13/00* (2006.01)

(52) U.S. Cl.
USPC ..... 2/167

(58) Field of Classification Search
USPC ..... 2/16, 20, 159, 161.1, 161.6, 163, 167, 2/168, 169; 128/879; 602/21; 156/251, 156/266, 285, 308.4
See application file for complete search history.

(56) References Cited

U.S. PATENT DOCUMENTS

| | | | |
|---|---|---|---|
| 1,855,809 | A | 4/1932 | Sheppard et al. |
| 2,810,161 | A | 10/1957 | Milton, Jr. |
| 3,124,807 | A | 1/1962 | Frenkel, et al. |
| 3,268,433 | A | 8/1966 | Abere |
| 3,281,498 | A | 10/1966 | Watkins et al. |
| 3,866,245 | A | 2/1975 | Sutherland |
| 3,870,150 | A | 3/1975 | Hummel |
| 4,034,853 | A | 7/1977 | Smith |
| 4,205,028 | A | 5/1980 | Brueggemann et al. |
| 4,430,759 | A | 2/1984 | Jackrel |
| 4,434,126 | A | 2/1984 | McGary, Jr. et al. |
| 4,463,156 | A | 7/1984 | McGary, Jr. et al. |
| 4,476,588 | A | 10/1984 | Long |
| 4,643,791 | A | 2/1987 | Jurrius et al. |
| 4,660,228 | A | 4/1987 | Ogawa et al. |
| 4,677,697 | A | 7/1987 | Hayes |
| 4,745,635 | A | 5/1988 | Kinnear |
| 4,804,432 | A | 2/1989 | Jurrius et al. |
| 4,918,755 | A | 4/1990 | Kinnear |
| 4,921,672 | A | 5/1990 | Bock |
| 5,093,422 | A | 3/1992 | Himes |

(Continued)

FOREIGN PATENT DOCUMENTS

| | | | |
|---|---|---|---|
| DE | 10014095 | A1 | 9/2001 |
| EP | 0350562 | A2 | 1/1990 |

(Continued)

OTHER PUBLICATIONS

Citation of Patent Applications.

(Continued)

*Primary Examiner* — Tejash Patel
(74) *Attorney, Agent, or Firm* — Dority & Manning, P.A.

(57) ABSTRACT

Elastomeric articles, such as gloves, are described that are made by welding two polymer films together. Polymer films are selected that have excellent elastic properties in combination with tensile strength properties. For instance, the polymer films can be made from a thermoplastic elastomer that has a tensile strength of greater than 40 MPa and has a modulus of from about 2 MPA to about 20 MPa.

24 Claims, 4 Drawing Sheets

(56) References Cited

U.S. PATENT DOCUMENTS

| | | | | |
|---|---|---|---|---|
| 5,451,439 | A | 9/1995 | Bigg | |
| 5,548,125 | A | 8/1996 | Sandbank | |
| 5,640,720 | A | 6/1997 | Sandbank | |
| 5,644,798 | A | 7/1997 | Shah | |
| 5,679,423 | A | 10/1997 | Shah | |
| 5,851,683 | A | 12/1998 | Plamthottam et al. | |
| 5,966,741 | A | 10/1999 | Klecina | |
| 5,997,676 | A | 12/1999 | Jurrius et al. | |
| 6,017,997 | A | 1/2000 | Snow et al. | |
| 6,021,524 | A | 2/2000 | Wu et al. | |
| 6,039,829 | A | 3/2000 | French | |
| 6,243,875 | B1 * | 6/2001 | French | 2/167 |
| 6,298,491 | B1 | 10/2001 | Blustin et al. | |
| 6,378,137 | B1 | 4/2002 | Hassan et al. | |
| 6,425,136 | B1 | 7/2002 | Schlamp et al. | |
| 6,514,572 | B1 | 2/2003 | Koonce et al. | |
| 6,602,452 | B2 | 8/2003 | Schuessler | |
| 6,637,035 | B1 | 10/2003 | Brinkmann et al. | |
| 6,641,879 | B1 | 11/2003 | Matsuura et al. | |
| 6,647,649 | B2 * | 11/2003 | Hunt et al. | 40/326 |
| 6,673,871 | B2 | 1/2004 | Warneke et al. | |
| 6,720,049 | B2 | 4/2004 | DiMaio | |
| 6,730,380 | B2 * | 5/2004 | Littleton et al. | 428/36.8 |
| 6,748,605 | B1 | 6/2004 | Brinkmann | |
| 6,874,165 | B2 * | 4/2005 | Lee | 2/168 |
| 6,895,600 | B2 | 5/2005 | Williams | |
| 7,012,169 | B2 * | 3/2006 | McDevitt et al. | 602/41 |
| 7,284,283 | B2 * | 10/2007 | Mack et al. | 2/161.6 |
| 7,294,678 | B2 | 11/2007 | McGlothlin et al. | |
| 7,407,694 | B2 * | 8/2008 | Taniguchi et al. | 428/35.7 |
| 7,504,145 | B2 | 3/2009 | Vance et al. | |
| 7,549,188 | B2 * | 6/2009 | McDevitt et al. | 15/227 |
| 7,922,854 | B2 | 4/2011 | Sabbagh et al. | |
| 2001/0051481 | A1 | 12/2001 | Carroll | |
| 2002/0010957 | A1 | 1/2002 | Katz | |
| 2005/0070682 | A1 | 3/2005 | Lawrey | |
| 2006/0143767 | A1 | 7/2006 | Yang et al. | |
| 2007/0112137 | A1 | 5/2007 | Niemark | |
| 2007/0220653 | A1 | 9/2007 | Mack et al. | |
| 2007/0240249 | A1 | 10/2007 | Poirier et al. | |
| 2008/0076315 | A1 | 3/2008 | McCormack et al. | |
| 2008/0102093 | A1 | 5/2008 | Close et al. | |
| 2008/0103460 | A1 | 5/2008 | Close et al. | |
| 2009/0286444 | A1 | 11/2009 | Hughes et al. | |
| 2010/0008957 | A1 | 1/2010 | Mundschau et al. | |
| 2012/0054943 | A1 | 3/2012 | Tao | |

FOREIGN PATENT DOCUMENTS

| | | | |
|---|---|---|---|
| FR | 1555846 | | 12/1967 |
| GB | 2164540 | A | 3/1986 |
| GB | 2264632 | A | 3/1993 |
| JP | 61-62540 | | 3/1986 |
| JP | 61-289102 | | 12/1986 |
| JP | 02-139401 | | 5/1990 |
| JP | 9-137310 | | 5/1997 |
| JP | 11-140715 | | 5/1999 |
| JP | 2000-175938 | | 6/2000 |
| JP | 2000-355809 | | 12/2000 |
| JP | 2002-317320 | | 10/2002 |
| JP | 2005-163193 | | 6/2005 |
| JP | 2006-118073 | | 5/2006 |
| JP | 2008-303286 | | 12/2008 |
| JP | 11-105888 | | 4/2011 |
| WO | 00/07671 | | 2/2000 |
| WO | 01/00408 | | 1/2001 |

OTHER PUBLICATIONS

Double Layers, Glove Making Machine; Alibaba.com; date unknown.

Food Disposable Glove Making Machine; Alibaba.com; date unknown.

Glove Machine; Alibaba.com; date unknown.

PE Glove Machine; Alibaba.com; date unknown.

PE Film Glove Making Machine; Alibaba.com; date unknown.

PE Glove Making Machine; Alibaba.com; date unknown.

Disposable Long Sleeve Glove Making Machine; Alibaba.com; date unknown.

International Search Report for PCT/IB2012/055121; dated May 2, 2013.

Kraton@ G1652 E Polymer Data Document; May 13, 2011.

* cited by examiner

ELASTOMERIC ARTICLES HAVING A WELDED SEAM THAT POSSESS STRENGTH AND ELASTICITY

BACKGROUND

Elastomeric articles made from natural or synthetic rubber are used in many different applications including being used as surgeon gloves, examination gloves, prophylactics, catheters, balloons, tubing, and the like. Elastomeric materials have been useful in the production of such articles because of their physical properties. For example, the materials not only can be stretched, but are also capable of substantially returning to their original shape when released.

Traditionally, elastomeric articles have been manufactured through the use of a mold or former in the shape of the final article to be produced. For example, when manufacturing a glove, a hand-shaped mold or former is first dipped in a coagulant slurry. After the slurry has dried on the former, the former is dipped in a rubber-type material, such as a natural or synthetic latex. The former may be dipped several times into the rubber material in order to build up a layer on the former of the desired thickness. The formed elastomeric article is then cured, cooled and stripped from the mold.

Multi-step dipping processes as described above can produce elastomeric articles, such as gloves, that are elastic, are form-fitting, have tactile sensitivity, and are chemically resistant. Unfortunately, however, the above described multi-step dipping process is both labor and energy intensive. Further, only certain types of rubber materials are amenable to the dipping process.

In an alternative embodiment, instead of producing gloves through a dipping process, gloves can also be produced by heat sealing together two layers of film. Forming a glove through a heat sealing process can be relatively less expensive. Unfortunately, however, problems have been experienced in the past in being able to produce heat sealed gloves that have elastic properties that provide tactile sensitivity. In this regard, the gloves typically do not have form-fitting properties, are typically made from a thicker film than dipped products, and are oversized in relation to a hand resulting in a poor fit.

In view of the above, improvements are needed in producing form-fitting gloves with excellent tactile sensitivity in a more cost-effective manner.

SUMMARY

The present disclosure is generally directed to producing elastic articles, such as gloves that are formed by welding film pieces together, as opposed to forming the elastic articles through a multiple dipping process. According to the present disclosure, elastic articles, such as gloves, can be produced more economically. In addition, the present disclosure is directed to selecting particular thermoplastic polymers that provide properties comparable to and even better than the properties obtained from conventional gloves made through a dipping process. For example, elastic gloves can be produced according to the present disclosure that not only have form-fitting properties and have all of the tactile characteristics of conventional gloves, but can also be stronger than latex gloves produced in the past.

In one embodiment, for instance, the present disclosure is directed to a glove comprising a first hand-shaped panel welded to a second hand-shaped panel along the peripheries. The first panel and the second panel are welded together in a manner that forms a hollow opening for receiving a hand. The first hand-shaped panel and the second hand-shaped panel are comprised of a thermoplastic polymer. Each hand-shaped panel is formed from an elastic film having a thickness of from about 0.25 mils to about 8 mils. In accordance with the present disclosure, the first hand-shaped panel and the second hand-shaped panel have a tensile strength of from about 40 MPa to about 100 MPa, such as from about 60 MPa to about 100 MPa. In addition, the first and second hand-shaped panels also have a modulus of from about 2 MPa to about 10 MPa, such as from about 5 MPa to about 10 MPa.

The above described glove can be made from cast films, blown films, or combinations thereof. The films can be welded together without the use of an adhesive, through, for instance, thermal bonding or ultrasonic bonding.

As described above, thermoplastic elastomers are selected for producing elastic articles in accordance with the present disclosure based upon a controlled set of properties or upon a desired application. Examples of thermoplastic elastomers that may be used include thermoplastic polyurethane elastomers, polyolefin plastomers, and/or styrenic block copolymers. When using a thermoplastic polyurethane elastomer, the polyurethane polymer can be polyether-based or polyester-based. In general, a thermoplastic polymer is selected that is capable of forming a cast or blown film, that is capable of being welded together, and that has a tensile strength and a modulus within the above defined ranges.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1A:
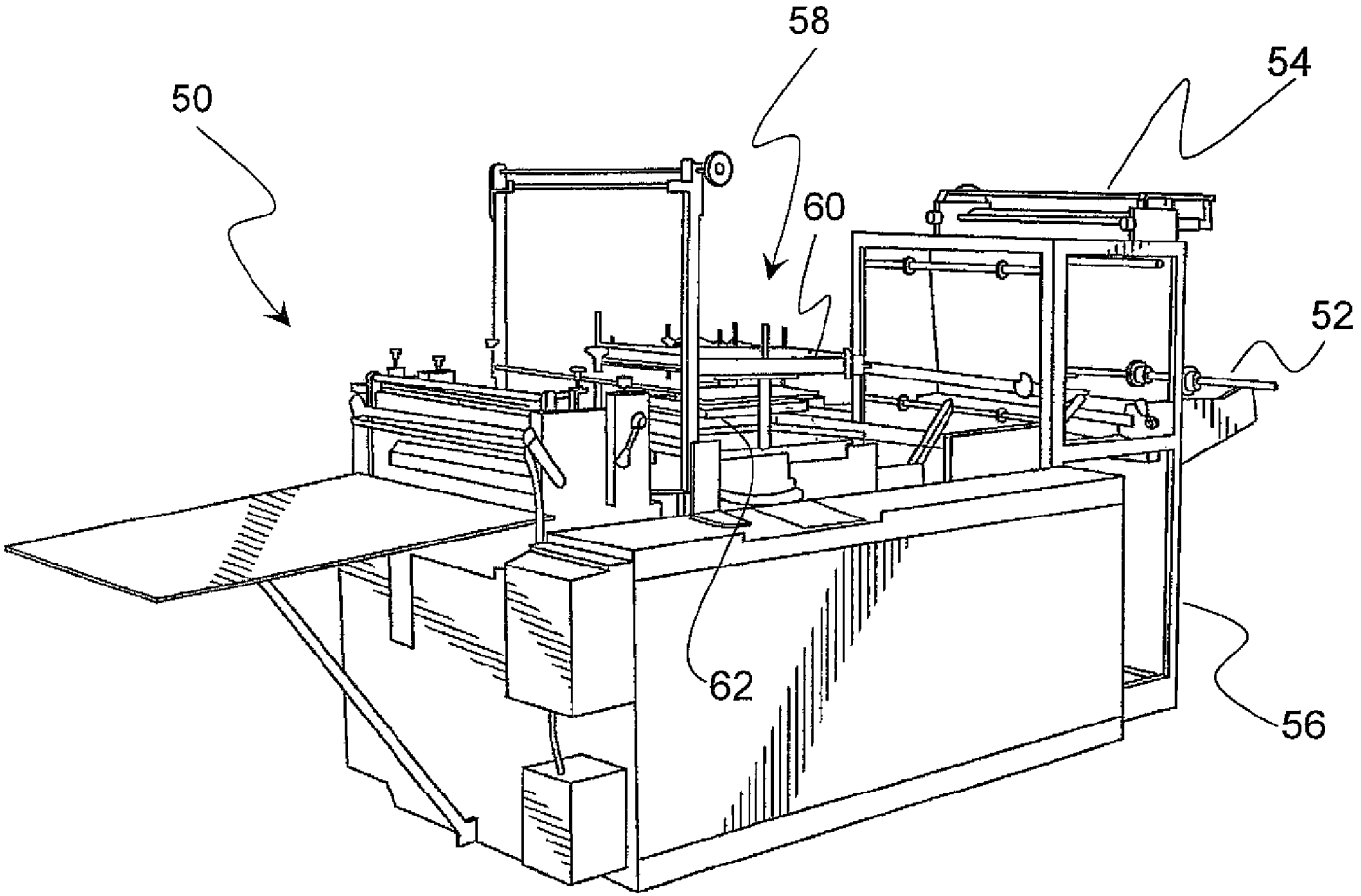
FIG. 1A is a perspective view of one embodiment of a process for making gloves in accordance with the present disclosure.

Repeat use of reference characters in the present specification and drawings is intended to represent the same or analogous features or elements of the present invention.

DEFINITIONS

As used herein, the term "elastomeric" and "elastic" and refers to a material that, upon application of a stretching force, is stretchable in at least one direction (such as the CD direction), and which upon release of the stretching force, contracts/returns to approximately its original dimension. For example, a stretched material may have a stretched length that is at least 50% greater than its relaxed unstretched length, and which will recover to within at least 50% of its stretched length upon release of the stretching force. A hypothetical example would be a one (1) inch sample of a material that is stretchable to at least 1.50 inches and which, upon release of the stretching force, will recover to a length of not more than 1.25 inches. Desirably, the material contracts or recovers at least 50%, and even more desirably, at least 80% of the stretched length.

As used herein the terms "extensible" or "extensibility" generally refers to a material that stretches or extends in the direction of an applied force by at least about 50% of its relaxed length or width. An extensible material does not necessarily have recovery properties. For example, an elastomeric material is an extensible material having recovery properties.

As used herein, the term "percent stretch" refers to the degree to which a material stretches in a given direction when subjected to a certain force. In particular, percent stretch is determined by measuring the increase in length of the material in the stretched dimension, dividing that value by the original dimension of the material, and then multiplying by 100. Specifically, the test uses two clamps, each having two jaws with each jaw having a facing in contact with the sample. The clamps hold the material in the same plane, usually vertically, separated by 2 inches and move apart at a specified rate of extension. The samples have a width of 2 inches and a length of 7 inches. The jaw facing height is 1 inch and width is 3 inches with a constant rate of extension of 300 mm/min. The specimen is clamped in, for example, a Sintech 2/S tester with a Renew MTS mongoose box (control) and using TESTWORKS 4.07b software (Sintech Corp, of Cary, N.C.). The test is conducted under ambient conditions. Results are generally reported as an average of three specimens and may be performed with the specimen in the cross direction (CD) and/or the machine direction (MD).

As used herein, the term "set" refers to retained elongation in a material sample following the elongation and recovery, i.e., after the material has been stretched and allowed to relax during a cycle test.

As used herein, the term "percent set" is the measure of the amount of the material stretched from its original length after being cycled (the immediate deformation following the cycle test). The percent set is where the retraction curve of a cycle crosses the elongation axis. The remaining strain after the removal of the applied stress (zero load) is measured as the percent set.

As used herein, the "hysteresis loss" of a sample may be determined by first elongating the sample ("load up") and then allowing the sample to retract ("load down"). The hysteresis loss is the loss of energy during this cyclic loading. The hysteresis loss is measured as a percentage. As used herein, the percent set and hysteresis loss are determined based on stretching a sample to 250% elongation and then allowing the sample to relax. The sample sizes for percent set and hysteresis loss are a width of 2 inches and a length of 7 inches. The same equipment and setup as described in determining percent stretch may be used to determine percent set and hysteresis loss.

As used herein, the term "weld" refers to securing at least a portion of a first polymer film with a portion of at least a second polymer film by temporarily rendering at least a portion of one film or an intermediate material into a softened or plastic state and joining the films without the use of mechanical attachments such as, for instance, stitching or without the use of an adhesive material that causes the films to stick together. Two or more films can be welded together in various ways such as through thermal bonding, ultrasonic bonding, pressure bonding, solvent bonding, or mixtures thereof.

As used herein, a "friction-reducing additive" refers to any material or composition incorporated into a layer or applied to a surface of a layer that reduces the static coefficient of friction. As used herein, the static coefficient of friction is measured according to ASTM Test D1894-11.

As used herein, an "elastomer" refers to any polymer material that is elastomeric or elastic and includes plastomers.

As used herein, the tensile properties of a film including modulus and load at break are measured according to ASTM Test D412-06 using Die D.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to producing elastic articles, such as form-fitting gloves from an elastic film. The film is comprised of at least one thermoplastic elastomer having desired properties. In order to produce elastic articles, such as gloves, multiples pieces of the film are welded together. For instance, when producing a glove, the glove can be produced according to a heat seal process. In accordance with the present disclosure, gloves can be produced having properties that are equivalent to or better than conventional dipped formed gloves. In fact, in one embodiment, gloves can be made that have all of the tactile properties of dipped formed gloves while being much stronger.

For instance, elastic articles made in accordance with the present disclosure can be formed from an elastic film having a tensile strength of greater than about 40 MPa, such as greater than about 50 MPa, such as greater than about 60 MPa, such as greater than about 70 MPa, such as even greater than about 80 MPa. In general, the tensile strength of the film will be less than about 100 MPa. The film can also have a modulus of greater than about 2 MPa, such as greater than about 5 MPa, such as greater than about 7 MPa. The modulus of the film, in one embodiment, may be less than about 25 MPa, such as less than about 10 MPa.

Figure 2:
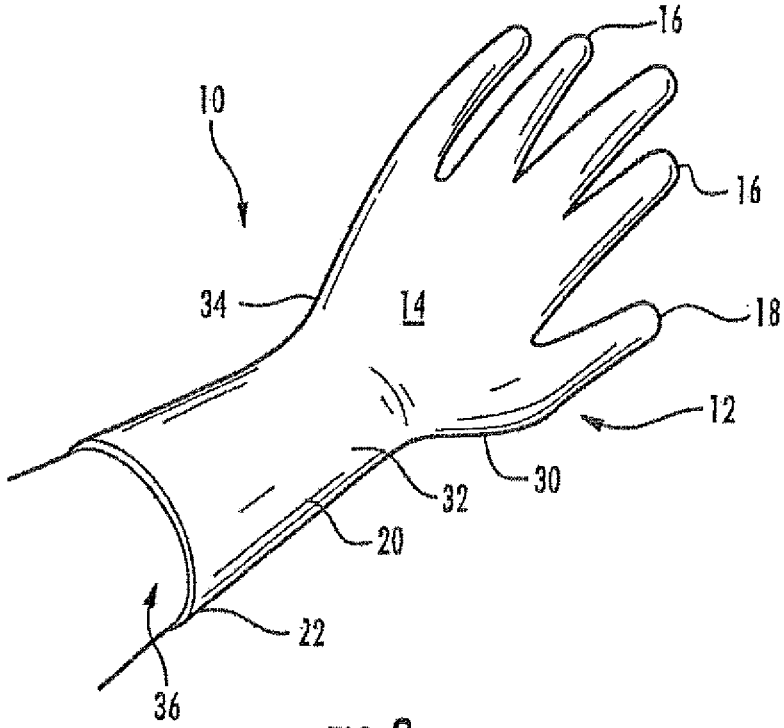
FIG. 2 is a perspective view of a glove made in accordance with the present disclosure.

Referring to FIG. 2, a glove 10 made in accordance with the present disclosure is shown. Although the figures and the following description generally refer to gloves, it should be understood that the teachings of the present disclosure can be used to produce other elastic articles. For instance, other elastic articles that may be made in accordance with the present disclosure include catheters, balloons, tubing, and the like.

As shown in FIG. 2, the glove 10 is generally in the shape of a hand. Of particular advantage, gloves made in accordance with the present disclosure have form-fitting properties in that the glove tightly conforms to the hand of a wearer and is elastic allowing the hand to freely move inside the glove.

The glove 10 includes a palm region 12, a back region 14, a plurality of finger regions 16, and a thumb region 18. The glove 10 can further include a wrist portion 20 terminating at a cuff 22.

In accordance with the present disclosure, the glove 10 includes a first hand-shaped panel 30 that is welded to a second hand-shaped panel 32. As will be described in greater detail below, the first panel 30 is welded to the second panel 32 to form a seam 34. The first and second panels are welded together about their peripheries in a manner that forms an opening 36 for receiving a hand. The seam 34 may not be visible after the panels are welded together.

Thermoplastic elastomers that may be used to produce the panels 30 and 32 can vary depending upon the particular application. In one embodiment, a thermoplastic elastomer film is selected that has desired elastic properties. For instance, the film can be made from thermoplastic elastomers such that the film can be stretched at least about 300%, such as at least about 400%, such as at least about 500%, such as at least about 600% without breaking or ripping.

In one embodiment, the film may also have hysteresis characteristics that are similar or better than materials used in the past to produce dip-formed gloves. For example, after being stretched 250% after one cycle, the film may have a hysteresis loss of less than about 100%, such as less than about 90%, such as less than about 80%, such as less than about 75%. In some embodiments, the film may have a low hysteresis loss such as less than about 60%, such as less than about 50%, such as less than about 40%, such as less than about 30%, such as less than about 20%, such as less than about 10%. After one cycle, the film may also have a percent set of less than about 95%, such as less than about 90%, such as less than about 85%, such as less than about 80%. Similar to hysteresis loss, the film may also have a percent set of less than about 70%, such as less than about 60%, such as less than about 50%, such as less than about 40%, such as less than about 30%, such as less than about 20%, such as less than about 10%. In general, the hysteresis loss and the percent set are greater than zero percent. As used herein, hysteresis loss and percent set are measured in the machine direction unless otherwise stated. Hysteresis loss and percent set can be measured at different thicknesses.

Of particular advantage, the film can have the above hysteresis characteristics while also possessing excellent strength characteristics. In fact, the film of the present disclosure may have strength characteristics better than many materials used to form dip-formed gloves, such as nitrile polymers and natural latex polymers. For example, the film may have a breaking strength (after three cycles of 250% elongation) of greater than about 10 N, such as greater than about 14 N, such as even greater than about 20 N. In general, the break strength is less than about 50 N.

Examples of thermoplastic elastomers that may be used to form the film include polyurethanes, polyolefins, styrenic block copolymers, polyether amides, and polyesters.

For example, in one embodiment, the film may be made from a thermoplastic polyurethane elastomer. Thermoplastic polyurethane elastomers generally include a soft segment and a hard segment. The soft segment can be derived from a long-chain diol while the hard segment may be derived from a diisocyanate. The hard segment may also be produced using chain extenders. For example, in one embodiment, a long-chain diol is reacted with a diisocyanate to produce a polyurethane prepolymer having isocyanate end groups. The prepolymer is then reacted with a chain extender, such as low molecular weight hydroxyl and amine terminated compounds. Suitable chain extenders include aliphatic dials, such as ethylene glycol, 1,4-butane diol, 1,6-hexane diol, and neopentyl glycol.

In one particular embodiment, the thermoplastic polyurethane elastomer may be polyether-based or polyester-based. In an alternative embodiment, the thermoplastic polyurethane elastomer may be formed with a polymethylene-based soft segment, such as a polytetramethylene glycol-based soft segment.

In one embodiment, a thermoplastic polyurethane elastomer is used that has a density of from about 1.0 g/cc to about 1.2 g/cc. For example, in one embodiment, the polyurethane elastomer is polyether-based and has a density of from about 1.04 g/cc to about 1.07 g/cc. In an alternative embodiment, the polyurethane elastomer includes polymethylene-based soft segments and has a density of from about 1.12 g/cc to about 1.15 g/cc.

The polyurethane elastomer can have a Shore A hardness (according to ASTM Test D2240) of generally greater than about 75 and generally less than about 95. In one embodiment, for instance, the polyurethane elastomer may have a Shore A hardness of greater than about 78, such as greater than about 80, such as from about 79 to about 82. In an alternative embodiment, the polyurethane elastomer may have a Shore A hardness of from about 75 to about 94, such as from about 86 to about 94.

The thermoplastic elastomer can have a melting range of from about 190° C. to about 225° C. In one embodiment, for instance, the melting range can be from about 195° C. to about 205° C. In an alternative embodiment, the melting range can be from about 200° C. to about 225° C.

The polyurethane elastomer can have a modulus at 100% elongation of generally greater than about 3 MPa, such as greater than about 5 MPa, such as greater than about 6 MPa, such as even greater than about 10 MPa. In general, the modulus at 100% elongation is less than about 20 MPa, such as less than about 15 MPa.

In addition to thermoplastic polyurethane elastomers, the film of the present disclosure may also be made from polyolefin elastomers, which includes herein polyolefin plastomers. The thermoplastic polyolefin may comprise, for instance, a polypropylene polymer, a polyethylene polymer, polybutylene polymer or a copolymer thereof.

In one particular embodiment, a polyolefin plastomer is used that comprises an alpha olefin copolymer, particularly an alpha olefin polyethylene copolymer. Suitable alpha-olefins may be linear or branched (e.g., one or more $C_1$-$C_3$ alkyl branches, or an aryl group). Specific examples include ethylene, 1-butene; 3-methyl-1-butene; 3,3-dimethyl-1-butene; 1-pentene; 1-pentene with one or more methyl, ethyl or propyl substituents; 1-hexene with one or more methyl, ethyl or propyl substituents; 1-heptene with one or more methyl, ethyl or propyl substituents; 1-octene with one or more methyl, ethyl or propyl substituents; 1-nonene with one or more methyl, ethyl or propyl substituents; ethyl, methyl or dimethyl-substituted 1-decene; 1-dodecene; and styrene. Particularly desired alpha-olefin comonomers are ethylene, 1-butene, 1-hexene and 1-octene. The ethylene content of such copolymers may be from about 60 mole % to about 99.5 wt. %, in some embodiments from about 80 mole % to about 99 mole %, and in some embodiments, from about 85 mole % to about 98 mole %. The alpha-olefin content may likewise range from about 0.5 mole % to about 40 mole %, in some embodiments from about 1 mole % to about 20 mole %, and in some embodiments, from about 2 mole % to about 15 mole %. The distribution of the alpha-olefin comonomer is typically random and uniform among the differing molecular weight fractions forming the ethylene copolymer.

Density of the thermoplastic polyolefin may generally be less than about 0.95 g/cc, such as less than about 0.91 g/cc. The density of the polyolefin is generally greater than about 0.8 g/cc, such as greater than about 0.85 g/cc, such as greater than about 0.88 g/cc. In one embodiment, for instance, a thermoplastic polyolefin is used that has a density of 0.885 g/cc or greater, such as from about 0.885 g/cc to about 0.91 g/cc.

The thermoplastic polyolefin may have a melt flow index when measured according to ASTM Test D1238 at 190° C. and at a load of 2.16 kg of from about 1 g/10 mins. to about 40 g/10 mins., such as from about 5 g/10 mins. to about 35 g/10 mins. At 230° C. and at a load of 2.16 kg, the melt flow index can be from about 1 g/10 min to about 350 g/10 min, such as from about 1 g/10 min to about 100 g/10 min.

In another embodiment, the thermoplastic polymer contained in the film may comprise a block copolymer. For example, the elastomer may be a substantially amorphous block copolymer having at least two blocks of a monoalkenyl arene polymer separated by at least one block of a saturated conjugated diene polymer. The monoalkenyl arene blocks may include styrene and its analogues and homologues, such as o-methyl styrene; p-methyl styrene; p-tert-butyl styrene; 1,3 dimethyl styrene p-methyl styrene; etc., as well as other monoalkenyl polycyclic aromatic compounds, such as vinyl naphthalene; vinyl anthrycene; and so forth. Preferred monoalkenyl arenes are styrene and p-methyl styrene. The conjugated diene blocks may include homopolymers of conjugated diene monomers, copolymers of two or more conjugated dienes, and copolymers of one or more of the dienes with another monomer in which the blocks are predominantly conjugated diene units. Preferably, the conjugated dienes contain from 4 to 8 carbon atoms, such as 1,3 butadiene (butadiene); 2-methyl-1,3 butadiene; isoprene; 2,3 dimethyl-1,3 butadiene; 1,3 pentadiene (piperylene); 1,3 hexadiene; and so forth. The amount of monoalkenyl arene (e.g., polystyrene) blocks may vary, but typically constitute from about 8 wt. % to about 55 wt. %, in some embodiments from about 10 wt. % to about 35 wt. %, and in some embodiments, from about 25 wt. % to about 35 wt. % of the copolymer. Suitable block copolymers may contain monoalkenyl arene endblocks having a number average molecular weight from about 5,000 to about 35,000 and saturated conjugated diene midblocks having a number average molecular weight from about 20,000 to about 170,000. The total number average molecular weight of the block polymer may be from about 30,000 to about 250,000.

Particularly suitable elastomers are available from Kraton Polymers LLC of Houston, Tex. under the trade name KRATON®. KRATON® polymers include styrene-diene block copolymers, such as styrene-butadiene, styrene-isoprene, styrene-butadiene-styrene, and styrene-isoprene-styrene. KRATON® polymers also include styrene-olefin block copolymers formed by selective hydrogenation of styrene-diene block copolymers. Examples of such styrene-olefin block copolymers include styrene-(ethylene-butylene), styrene-(ethylene-propylene), styrene-(ethylene-butylene)-styrene, styrene-(ethylene-propylene)-styrene, styrene-(ethylene-butylene)-styrene-(ethylene-butylene), styrene-(ethylene-propylene)-styrene-(ethylene-propylene), and styrene-ethylene-(ethylene-propylene)-styrene. These block copolymers may have a linear, radial or star-shaped molecular configuration. Specific KRATON® block copolymers include those sold under the brand names G 1652, G 1657, G 1730, MD6673, and MD6937. Various suitable styrenic block copolymers are described in U.S. Pat. Nos. 4,663,220, 4,323,534, 4,834,738, 5,093,422 and 5,304,599, which are hereby incorporated in their entirety by reference thereto for all purposes. Other commercially available block copolymers include the S-EP-S elastomeric copolymers available from Kuraray Company, Ltd. of Okayama, Japan, under the trade designation SEPTON®. Still other suitable copolymers include the S-I-S and S-B-S elastomeric copolymers available from Dexco Polymers of Houston, Tex. under the trade designation VECTOR®. Also suitable are polymers composed of an A-B-A-B tetrablock copolymer, such as discussed in U.S. Pat. No. 5,332,613 to Taylor, et al., which is incorporated herein in its entirety by reference thereto for all purposes. An example of such a tetrablock copolymer is a styrene-poly(ethylene-propylene)-styrene-poly(ethylene-propylene) ("S-EP-S-EP") block copolymer.

Various thermoplastic elastomers that may be incorporated into elastic articles in accordance with the present disclosure include ARNITEL polymers available from DSM Engineering Plastics, VISTAMAXX polymers available from ExxonMobil Chemical Company, AFFINITY polymers available from The Dow Chemical Company, SANTOPRENE polymers available from ExxonMobil Chemical Company, PEARLTHANE polymers available from Merquinsa, PELLETHANE polymers available from Lubrizol, PEBAX polymers available from Arkema Technical Polymers, ESTANE polymers available from Lubrizol, INFUSE polymers available from The Dow Chemical Company, and the like.

The elastic film used to produce elastic articles, such as gloves, in accordance with the present disclosure may comprise a monolayer film or may comprise a multi-layer film. In general, the film has a thickness of less than about 8 mils, such as less than about 6 mils, such as less than about 5 mils, such as less than about 4 mils. In general, the elastic film has a thickness greater than about 0.25 mils, such as greater than about 0.5 mils, such as greater than about 1 mil.

In addition to a thermoplastic polymer, the elastic film may contain various other additives, components and surface treatments. In one embodiment, for instance, the elastic film may contain a friction-reducing additive that is configured to reduce the friction of the inside surface of a glove made from the film. For instance, when formed into a glove, the inside surface of the glove may have a static coefficient of friction of less than about 0.3, such as less than about 0.25, such as less than about 0.2 when measured according to ASTM Test D1894-11.

The friction-reducing additive may comprise particles incorporated into the elastic film. The particles may comprise, for instance, filler particles, such as aluminum oxide particles or silicon dioxide particles. In addition to the above particles, various other filler particles may be used as the friction-reducing additive. For instance, other particles that may be used include calcium carbonate particles, mica, and the like. The particles can be incorporated into the film in a manner that disrupts the surface of the outer layer for reducing friction. The particles can be completely embedded within the film.

The size of the particles and the amount of particles contained in the film can vary depending upon the particular application. In general, the particles are incorporated into the film layer in an amount from about 5% to about 50% by weight, such as in an amount from about 10% to about 40% by weight. The particles generally have a size of less than about 15 microns, such as less than about 10 microns. The particles generally have a size greater than 1 micron, such as greater than about 2 microns.

In an alternative embodiment, the friction-reducing additive may comprise nanoparticles, such as particles having a particle size of less than 1 micron, such as less than 0.5 microns, such as less than about 0.1 microns. Such particles may be incorporated into the film in relatively small amounts, such as in amounts from about 0.1% to about 10% by weight.

In another embodiment of the present disclosure, the friction-reducing additive may comprise a fluorocarbon compound, silicone or a fatty acid (which includes fatty acid derivatives) which may be combined with the polymer used to form the elastic film or may be applied to a surface of the film. As used herein, the term "silicone" generally refers to a broad family of synthetic polymers that have a repeating silicon-oxygen backbone, including, but not limited to, polydimethylsiloxane and polysiloxanes having hydrogen-bonding functional groups selected from the group consisting of amino, carboxyl, hydroxyl, ether, polyether, aldehyde, ketone, amide, ester, and thiol groups.

Generally, any silicone capable of enhancing the donning characteristics of the glove may be used. In some embodiments, polydimethylsiloxane and/or modified polysiloxanes may be used as the silicone component. For instance, some suitable modified polysiloxanes that may be used include, but are not limited to, phenyl-modified polysiloxanes, vinyl-modified polysiloxanes, methyl-modified polysiloxanes, fluoro-modified polysiloxanes, alkyl-modified polysiloxanes, alkoxy-modified polysiloxanes, amino-modified polysiloxanes, and combinations thereof.

Some suitable phenyl-modified polysiloxanes include, but are not limited to, dimethyldiphenylpolysiloxane copolymers; dimethyl, methylphenylpolysiloxane copolymers; polymethylphenylsiloxane; and methylphenyl, dimethylsiloxane copolymers.

As indicated above, fluoro-modified polysiloxanes may also be used in the present invention. For instance, one suitable fluoro-modified polysiloxane that may be used is a trifluoropropyl modified polysiloxane, such as a trifluoropropylsiloxane modified dimethylpolysiloxane. A trifluoropropylsiloxane modified dimethylpolysiloxane may be synthesized by reacting methyl, 3,3,3 trifluoropropylsiloxane with dimethylsiloxane.

Besides the above-mentioned modified polysiloxanes, other modified polysiloxanes may also be utilized. For instance, some suitable vinyl-modified polysiloxanes include, but are not limited to, vinyldimethyl terminated polydimethylsiloxanes; vinylmethyl, dimethylpolysiloxane copolymers; vinyldimethyl terminated vinylmethyl, dimethylpolysiloxane copolymers; divinylmethyl terminated polydimethylsiloxanes; and vinylphenylmethyl terminated polydimethylsiloxanes. Further, some methyl-modified polysiloxanes that may be used include, but are not limited to, dimethylhydro terminated polydimethylsiloxanes; methylhydro, dimethylpolysiloxane copolymers; methylhydro terminated methyloctyl siloxane copolymers; and methylhydro, phenylmethyl siloxane copolymers. In addition, some examples of amino-modified polysiloxanes include, but are not limited to, polymethyl(3-aminopropyl)-siloxane and polymethyl[3-(2-aminoethyl)aminopropyl]-siloxane.

In one embodiment, filler particles may also be incorporated into the elastic film in order to facilitate gripping or reduce blocking or the tendency of the gloves to stick together. When incorporated for the purpose of enhancing donning, the particles are generally applied to the interior surface of the elastic film. When applied to the opposite surface, however, in one embodiment, the particles can enhance gripping. For instance, in one embodiment, the particles may include colloidal silica particles that remain partially exposed on the outside surface of the film.

In still another embodiment, the elastic film may contain electrically conductive particles. The electrically conductive particles may allow static charges to be dissipated where anti-static performance is desired. For instance, in one embodiment, the particles may comprise colloidal silica particles that are coated so as to be rendered electrically conductive. For example, one embodiment of an electrically conductive surface treatment comprises aluminum chlorohydrate. In other embodiments, the particles may be coated with a metal.

In addition to the above, the elastic film may also contain one or more coloring agents. The coloring agent may comprise dyes, pigments, particles, or any other material capable of imparting color and/or opacity to the elastic film.

Figure 1B:
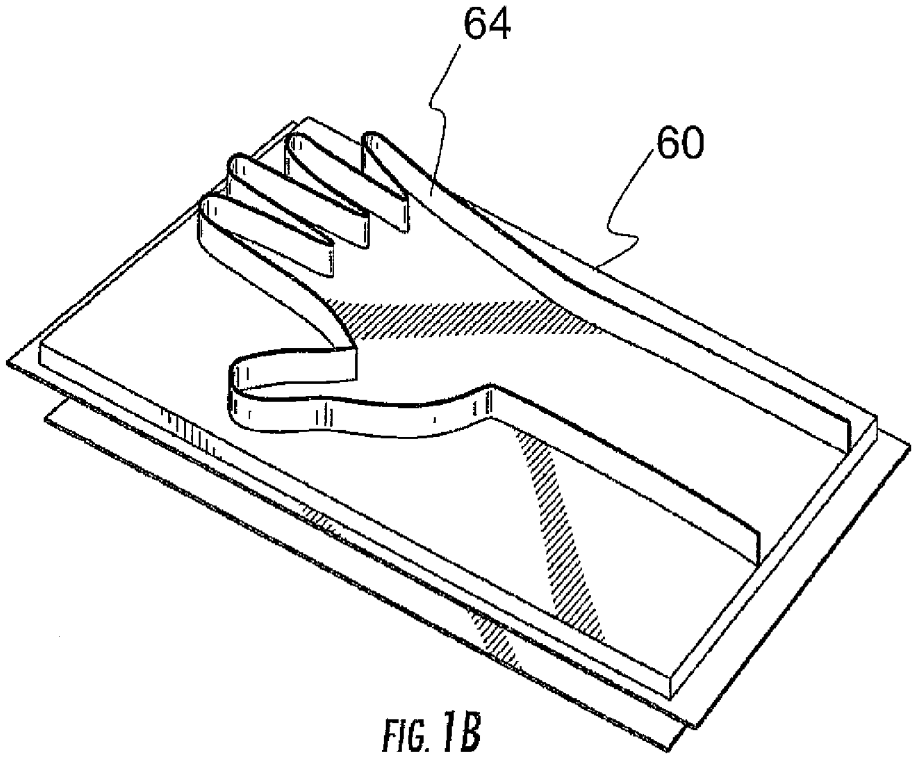
FIG. 1B is a perspective view of a hand-shaped wire that may be used in the apparatus illustrated in FIG. 1A.

Referring to FIGS. 1A and 1B, for instance, one embodiment of a system for producing welded gloves from the film is illustrated. As shown in FIG. 1A, the system 50 includes a plurality of roll letoffs 52 and 54 for feeding multiple plies of the film into the process. In the embodiment illustrated in FIG. 1A, the system 50 includes a first roll letoff 52 and a second roll letoff 54 that are each configured to support and unwind a spirally wound roll of the film of the present disclosure. In other embodiments, the system 50 may include more than two roll letoffs for feeding more than two plies of the film into the process. In one embodiment, for instance, the thumb portion of a glove may be formed separately from the finger portions. In this embodiment, a third roll letoff may be used to create the thumb portion which is then welded to the glove separately.

The glove-making system 50 as shown in FIG. 1A generally includes a frame 56 that supports the components including the roll letoffs 52 and 54.

When forming gloves using the system 50 as shown in FIG. 1A, at least two plies of the film are unwound from the roll letoffs 52 and 54 and fed to at least one die device 58. The die device 58, which may be hydraulically or pneumatically operated, includes a pair of opposing platens 60 and 62. The platens 60 and 62 come together and form a glove from the two plies of film while the plies of film are in a superimposed relationship.

For example, in one embodiment, the top platen 60 as shown in FIG. 1B may include a welding device 64 which delivers energy to the two plies of film. For instance, the welding device 64 may comprise a heated wire or may comprise an ultrasonic device that welds the two plies of film together in the shape of a glove while also simultaneously cutting the glove from the plies of film. The formed glove is then collected while the film scrap is fed downstream and reused as desired.

Of particular advantage, as shown in FIG. 1B, a welding device 64 may be used that produces a glove with form-fitting properties. In this regard, the resulting glove can fit tightly and snugly on one's hand as opposed to being "baggy".

The present disclosure may be better understood with reference to the following example.

EXAMPLE

Various different thermoplastic polymers were formed into films. The films were then subjected to various tests. In particular, the films were tested for strength and for their elastic properties.

More particularly, 18 different film samples were produced. Sample Nos. 1-16 comprised cast films. Film Sample Nos. 17 and 18 included a nitrile polymer film and a natural rubber latex film which are materials typically used to produce dip-formed gloves. These polymer films were tested for purposes of comparison.

Figure 3:
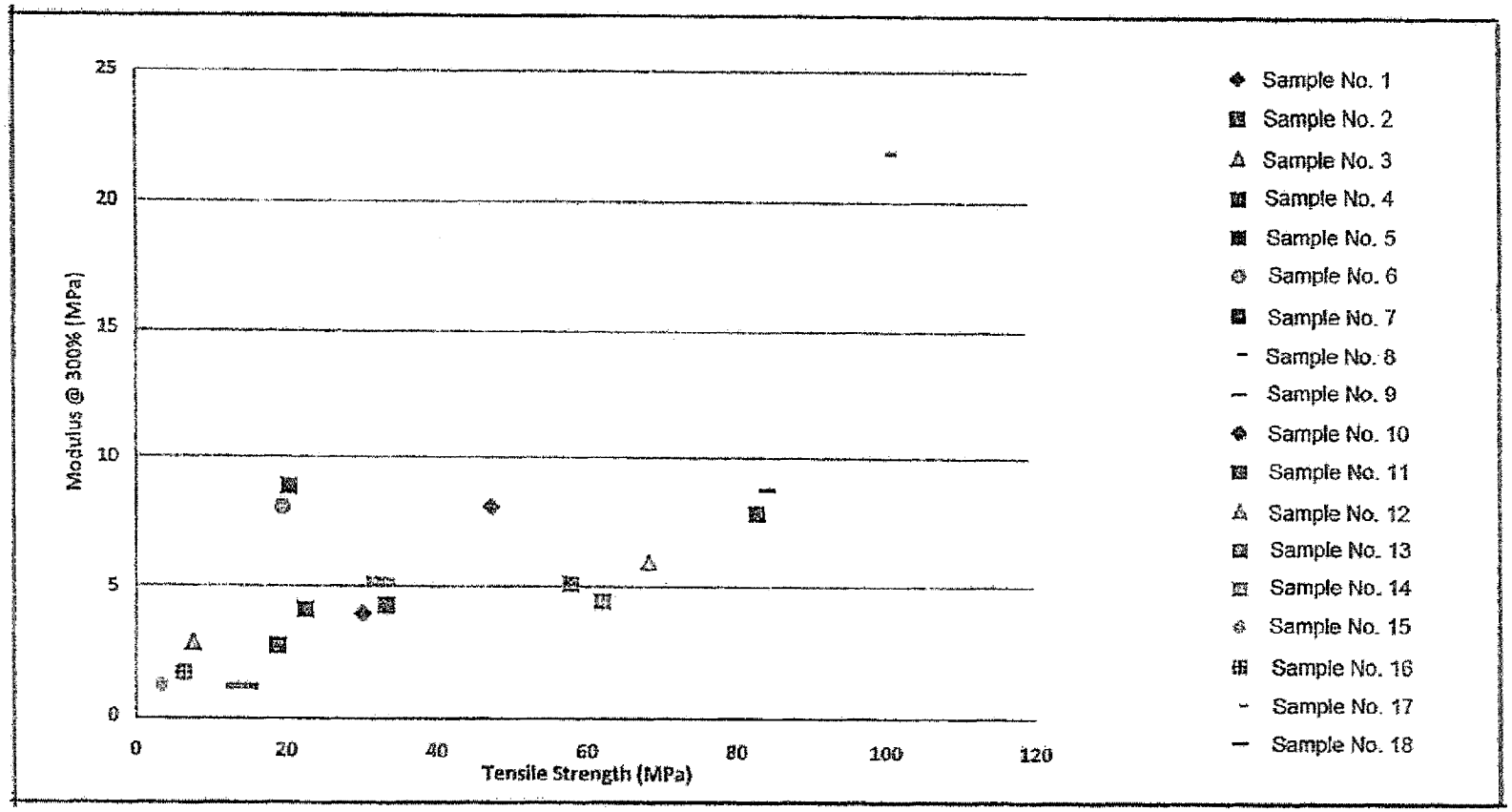
FIG. 3 is a graphical representation of the results obtained in the example described below.

The following film samples were tested:

Sample No. 1
polymer—thermoplastic copolyester elastomer
Density—1.110 g/cc
Melt Temp.—195.0° C.
Hardness—34 D
Sample No. 2
polymer—propylene-based olefinic elastomer
Density—0.861 g/cc
Hardness—61 A
Sample No. 3
polymer—propylene-based olefinic elastomer
Density—0.868 g/cc
Hardness—77 A
Sample No. 4
polymer—polyolefin plastomer made from ethylene-octene copolymers
Density—0.885 g/cc
Melt Temp.—83.0° C.
Sample No. 5
polymer—non-hygroscopic thermoplastic vulcanizate TPE
Density—0.930 g/cc Melt Temp.—196-224° C.
Hardness—90 A
Sample No. 6
polymer—versatile thermoplastic vulcanizate TPE
Density—0.960 g/cc
Melt Temp.—204° C.
Hardness 87 A
Sample No. 7
polymer—thermoplastic polyurethane elastomer that is polyether copolymer based
Density—1.05 g/cc
Melt Temp.—195-205° C.
Hardness—82 A
Sample No. 8
polymer—polyurethane elastomer that includes polytetramethylene glycol based soft segments
Density—1.14 g/cc
Melt Temp.—204-221° C.
Hardness—86-94 A
Sample No. 9
polymer—polyurethane elastomer that includes polytetramethylene glycol based soft segments
Density—1.13 g/cc
Melt Temp.—192-210° C.
Hardness—77-84 A
Sample No. 10
polymer—styrene ethylene/butylene styrene block copolymer
Sample No. 11
polymer—thermoplastic elastomer made of polyether and rigid polyamide blocks
Density—1.00 g/cc
Melt Temp.—134° C.
Hardness—27 D
Sample No. 12
polymer—thermoplastic polyurethane elastomer that is polyether based
Density—1.06 g/cc
Hardness—79 A
Sample No. 13
polymer—polyether-based thermoplastic polyurethane elastomer
Density—1.07 g/c
Melt Temp.—136° C.
Hardness—75 A
Sample No. 14
polymer—thermoplastic polyurethane elastomer that is polyether based
Density—1.06 g/cc
Hardness—74 A
Sample No. 15
polymer—olefin block copolymer
Density—0.866 g/cc
Melt Temp.—118° C.
Hardness—55 A
Sample No. 16
polymer—olefin block copolymer
Density—0.877 g/cc
Melt Temp.—120° C.
Hardness—71 A
Sample No. 17
polymer—nitrile polymer
Sample No. 18
polymer—natural rubber latex The above film samples were then tested for modulus and tensile strength. The results are illustrated in FIG. 3. The film samples were tested according to ASTM Test D412 using Die D (3 mil thickness).

As shown in FIG. 3, film sample nos. 4, 7, 8, 9, 10, 12 and 14 had a tensile strength of greater than 40 MPa and had a modulus of from about 2 MPa to about 25 MPa.

Most of the above films were also tested for hysteresis loss and percent set (3 mil to 6 mm thickness). In particular, the film samples were stretched to 250% elongation and then relaxed (1 cycle).

In general, a higher hysteresis loss indicates that the sample is exhibiting less energy when relaxed (force pulling back). The higher percent set, on the other hand, indicates less elasticity. The following results were obtained:

| Sample Number | Direction (MD/CD) | Hysteresis Loss C1 (%) | Percent Set C1 (%) |
|---|---|---|---|
| Sample No. 1 | MD | 76 | 42 |
| Thermoplastic Copolyester Elastomer | CD | 76 | 57 |
| Sample No. 2 | MD | 59 | 43 |
| Propylene Elastomer | CD | 60 | 43 |
| Sample No. 3 | MD | 79 | 66 |
| Propylene Elastomer | CD | 82 | 70 |
| Sample No. 4 | MD | 80 | 60 |
| Polyolefin Plastomer | CD | 79 | 57 |
| Sample No. 5 | MD | 90 | 87 |
| Thermoplastic Vulcanizate | CD | N/A | N/A |
| Sample No. 6 | MD | 90 | 87 |
| Thermoplastic Vulcanizate | CD | 89 | 86 |
| Sample No. 7 | MD | 61 | 45 |
| Thermoplastic Polyurethane Elastomer | CD | 63 | 47 |
| Sample No. 8 | MD | 72 | 60 |
| Thermoplastic Polyurethane Elastomer | CD | 74 | 57 |
| Sample No. 9 | MD | 65 | 49 |
| Thermoplastic Polyurethane Elastomer | CD | 66 | 49 |
| Sample No. 10 | MD | 68 | 48 |
| Styrene-Ethylene/Butylene-Styrene | CD | 67 | 46 |
| Sample No. 11 | MD | 64 | 48 |
| Polyether Block Amide | CD | 63 | 48 |
| Sample No. 12 | MD | 46 | 39 |
| Thermoplastic Polyurethane Elastomer | CD | 46 | 35 |
| Sample No. 13 | MD | 53 | 41 |
| Thermoplastic Polyurethane Elastomer | CD | 54 | 42 |
| Sample No. 14 | MD | 61 | 53 |
| Thermoplastic Polyurethane Elastomer | CD | N/A | N/A |
| Sample No. 15 | MD | 55 | 34 |
| Olefin Block Copolymer | CD | 54 | 34 |
| Sample No. 16 | MD | 67 | 45 |
| Olefin Block Copolymer | CD | 67 | 43 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A glove comprising:

a first hand-shaped panel defining a periphery;

a second hand-shaped panel also defining a periphery, the second hand-shaped panel being welded to the first hand-shaped panel about the peripheries in a manner that forms a hollow opening for receiving a hand, the first hand-shaped panel and the second hand-shaped panel being comprised of a film containing an elastomeric polymer, the first hand-shaped panel and the second hand-shaped panel having a thickness of less than about 8 mils, the first hand-shaped panel and the second hand-shaped panel having a tensile strength of at least about 40 MPa and having a modulus of from about 2 MPa to about 25 MPa.

2. A glove as defined in claim 1, wherein the film has a hysteresis loss after being stretched to 250% elongation of less than about 100% and has a percent set of less than about 95%.

3. A glove as defined in claim 1, wherein the film has a hysteresis loss after being stretched to 250% elongation of less than about 80% and has a percent set of less than about 80%.

4. A glove as defined in claim 1, wherein the film has a hysteresis loss after being stretched to 250% elongation of less than about 50%.

5. A glove as defined in claim 1, wherein the film has a percent set after being stretched to 250% elongation of less than about 50%.

6. A glove as defined in claim 1, wherein the film comprises a friction-reducing additive such that an inside surface of the glove has a static coefficient of friction of less about 0.3.

7. A glove as defined in claim 1, wherein the first hand-shaped panel and the second hand-shaped panel have a modulus of from about 2 MPa to about 10 MPa.

8. A glove as defined in claim 1, wherein the first hand-shaped panel and the second hand-shaped panel comprise a single ply film that is not laminated to any other material layers.

9. A glove as defined in claim 1, wherein the first hand-shaped panel and the second hand-shaped panel are formed from a film made from the same elastomeric polymer.

10. A glove as defined in claim 1, wherein the first hand-shaped panel is welded to the second hand-shaped panel by thermally bonding the first hand-shaped panel and the second hand-shaped panel together.

11. A glove as defined in claim 1, wherein the first hand-shaped panel is welded to the second hand-shaped panel by ultrasonically bonding the first hand-shaped panel and the second hand-shaped panel together.

12. A glove as defined in claim 1, wherein the elastomeric polymer comprises a thermoplastic polyurethane elastomer.

13. A glove as defined in claim 1, wherein the first hand-shaped panel and the second hand-shaped panel have a tensile strength of at least about 60 MPa and has a modulus of from about 5 MPa to about 10 MPa.

14. A glove as defined in claim 1, wherein the first hand-shaped panel and the second hand-shaped panel are formed from cast films.

15. A glove as defined in claim 1, wherein the first hand-shaped panel and the second hand-shaped panel are formed from blown films.

16. A glove as defined in claim 1, wherein the first hand-shaped panel and the second hand-shaped panel do not contain a natural rubber latex, a nitrile polymer, a polychloroprene polymer or an isoprene polymer.

17. A glove as defined in claim 1, wherein the elastomeric polymer comprises a polyolefin plastomer or a styrenic block copolymer.

18. A glove as defined in claim 12, wherein the thermoplastic polyurethane elastomer is polyether-based.

19. A glove as defined in claim 12, wherein the thermoplastic polyurethane elastomer includes polymethylene-based soft blocks.

20. A glove as defined in claim 12, wherein the thermoplastic polyurethane elastomer is polyester-based.

21. A glove as defined in claim 1, wherein the elastomeric polymer comprises a polyolefin elastomer.

22. A glove as defined in claim 1, wherein the elastomeric polymer comprises an alpha olefin copolymer.

23. A glove as defined in claim 1, wherein the elastomeric polymer comprises a styrenic block copolymer.

24. A glove as defined in claim 1, wherein the elastomeric polymer comprises a styrene-ethylene butylene-styrene block copolymer.

* * * * *